US007544879B2

(12) United States Patent
Takami

(10) Patent No.: US 7,544,879 B2
(45) Date of Patent: Jun. 9, 2009

(54) TONE GENERATION PROCESSING APPARATUS AND TONE GENERATION ASSIGNMENT METHOD THEREFOR

(75) Inventor: Keishi Takami, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 579 days.

(21) Appl. No.: 11/182,237

(22) Filed: Jul. 14, 2005

(65) Prior Publication Data

US 2006/0011043 A1 Jan. 19, 2006

(30) Foreign Application Priority Data

Jul. 15, 2004 (JP) ..... 2004-208301

(51) Int. Cl.
*G10H 7/00* (2006.01)

(52) U.S. Cl. ..... 84/604; 84/603; 84/609; 84/615; 84/622; 84/627

(58) Field of Classification Search ..... 84/604, 84/615, 603, 609, 622, 627
See application file for complete search history.

(56) References Cited

U.S. PATENT DOCUMENTS 4,602,545 A * 7/1986 Starkey ..... 84/607
4,773,294 A * 9/1988 Iizuka et al. ..... 84/622
4,969,385 A * 11/1990 Williams et al. ..... 84/656
5,382,749 A * 1/1995 Fujita et al. ..... 84/603
5,463,183 A * 10/1995 Konno ..... 84/604
5,486,644 A * 1/1996 Kudo et al. ..... 84/604
5,698,802 A * 12/1997 Kamiya ..... 84/604
5,804,754 A * 9/1998 Iwase et al. ..... 84/617
5,895,877 A * 4/1999 Tamura ..... 84/625

(Continued)

FOREIGN PATENT DOCUMENTS

EP 1 026 661 8/2000

(Continued)

OTHER PUBLICATIONS

Notice of Grounds for Rejection (Office Action) for Japanese Patent Application No. 2004-208301, mailed Nov. 13, 2008.

*Primary Examiner*—Jeffrey Donels
*Assistant Examiner*—Christina Russell
(74) *Attorney, Agent, or Firm*—Morrison & Foerster LLP

(57) ABSTRACT

A plurality of tone generator devices include respective waveform data memories, and each of the waveform data memories is exclusively usable by the corresponding tone generator device, not sharable with the tone generator device. Once event information indicative of a tone to be generated is received, a selection is made, from among the plurality of tone generator devices, a particular tone generator device to be used for generating the tone corresponding to the event information. The selection can be made by determining, with reference to a table, in which of the memories of the tone generator waveform data to be used are stored. For example, first waveform data corresponding to a first pitch range and second waveform data, differing in waveform characteristic from the first waveform data and corresponding to a second pitch range, are stored in the waveform data memories corresponding to different ones of the tone generator devices. The event information is delivered to the selected tone generator device so that a waveform signal of a tone indicated by the received event information is generated by the selected tone generator device.

10 Claims, 2 Drawing Sheets

U.S. PATENT DOCUMENTS

| | | | | |
|---|---|---|---|---|
| 5,942,707 | A * | 8/1999 | Tamura | 84/604 |
| 5,945,619 | A * | 8/1999 | Tamura | 84/604 |
| 5,955,691 | A * | 9/1999 | Suzuki et al. | 84/604 |
| 6,353,171 | B2 * | 3/2002 | Tamura | 84/603 |
| 6,414,232 | B2 * | 7/2002 | Ikeya | 84/604 |
| 6,525,254 | B2 * | 2/2003 | Tsutsumi | 84/615 |
| 6,535,772 | B1 * | 3/2003 | Miyamori et al. | 700/90 |
| 6,576,826 | B2 * | 6/2003 | Kondo et al. | 84/615 |
| 6,872,877 | B2 * | 3/2005 | Suzuki et al. | 84/609 |
| 7,378,586 | B2 * | 5/2008 | Okazaki | 84/604 |
| 2001/0022130 | A1 * | 9/2001 | Ikeya | 84/615 |
| 2001/0054348 | A1 * | 12/2001 | Ikeya | 84/604 |

FOREIGN PATENT DOCUMENTS

| | | | |
|---|---|---|---|
| EP | 1026661 | A2 * | 8/2000 |
| EP | 1168296 | A2 * | 1/2002 |
| EP | 1 168 296 | | 2/2002 |
| JP | HEI 09-146551 | | 6/1997 |

* cited by examiner

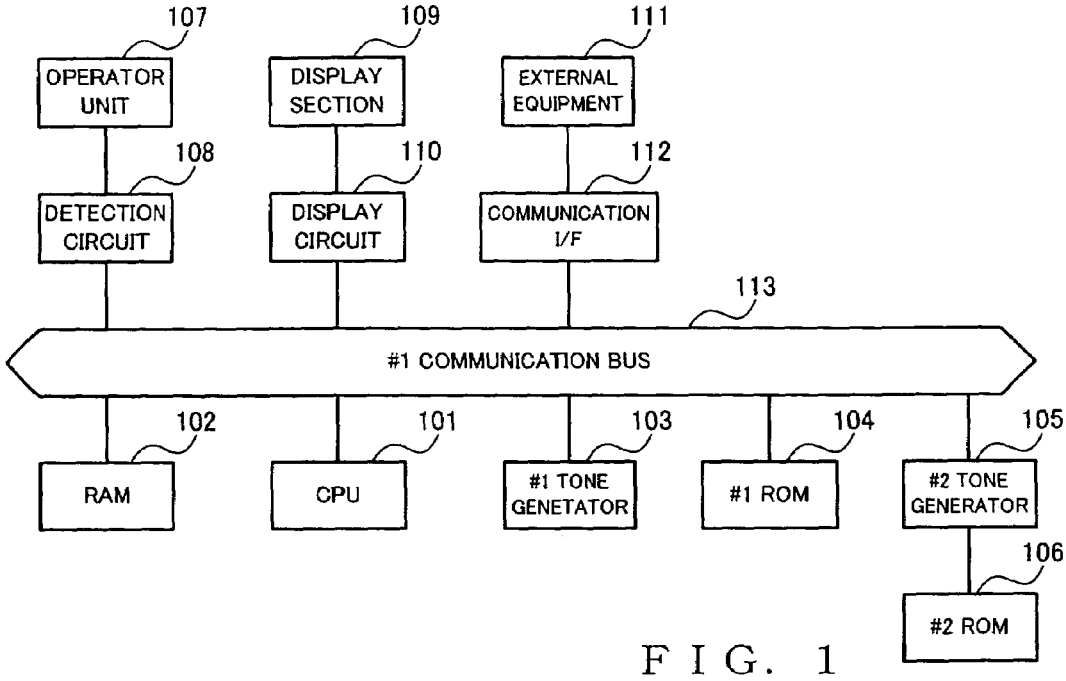
F I G. 1
| TONE COLOR NO. | KEY BANK NO. | KEY NO. RANGE | TONE GENERATOR NO. |
|---|---|---|---|
| TC01 | KB01 | 00-23 | #1 |
| TC01 | KB02 | 24-35 | #2 |
| TC01 | KB03 | 36-41 | #1 |
| . | . | . | . |
| . | . | . | . |
| TC02 | KB01 | 00-35 | #1 |
| TC02 | KB02 | 36-47 | #2 |
| . | . | . | . |
| . | . | . | . |
F I G. 2
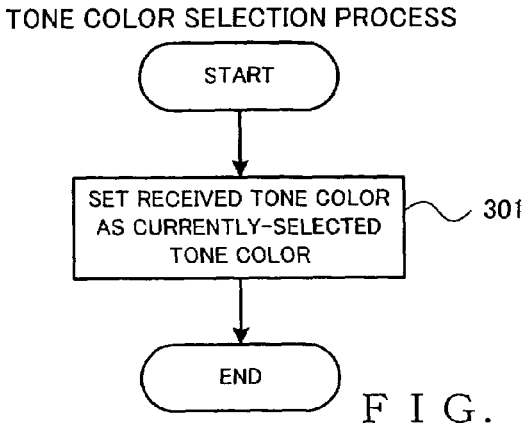
F I G. 3

TONE GENERATION PROCESSING APPARATUS AND TONE GENERATION ASSIGNMENT METHOD THEREFOR

BACKGROUND OF THE INVENTION

The present invention relates to a technique for permitting construction or implementation, at low cost, of an apparatus which can use a plurality of tone generator devices with no function to share a same waveform memory, to perform processing similar to that performed by a plurality of tone generator devices with a function to share a same waveform memory.

Heretofore, tone generator apparatus have been known, which use two tone generators (e.g., in the form of tone generator chips) to increase the number of tone generation channels (CHs) and store, in a single waveform (data) memory, all waveform data to be used for generation of tones, and in which each of the two tone generators can read out waveform data from the waveform memory. In Japanese patent Application Laid-open Publication No. HEI-9-146551, for example, there is disclosed a waveform-memory-based tone generator apparatus, in which a single waveform memory is shared between two tone generators and in which the tone generators can each access the same waveform memory on a time-divisional basis to thereby read out waveform data from the memory substantially simultaneously; that is, the disclosed tone generator apparatus has a waveform memory sharing function. With the disclosed technique, any newly-generated tone generation instruction can be allotted to any of the channels of the two tone generators.

In the tone generator apparatus disclosed in the No. HEI-9-146551, the two tone generators each have to have a function for sharing the waveform memory (i.e., waveform-memory sharing function). Generally, the tone generator having a waveform-memory sharing function and the tone generator having no waveform-memory sharing function significantly differ in price; namely, the tone generator with the waveform-memory sharing function is more expensive than the tone generator without the waveform-memory sharing function. Whereas the tone generator without the waveform-memory sharing function is inexpensive, it can use only a dedicated waveform memory. Thus, as the number of tone generators is increased to increase the number of channels, there also arises a need to increase the number of waveform memories for storing waveform data. Particularly, in order to allow sets of waveform data, representative of all tone colors used in the apparatus, to be shared between two tone generators, it is necessary to prestore all of such necessary sets of waveform data redundantly in both of the waveform memories of the two tone generators. Providing two waveform memories storing all necessary sets of waveform data as mentioned above would result in increased memory cost.

SUMMARY OF THE INVENTION

In view of the foregoing, it is an object of the present invention to provide a technique which permits construction or implementation, at low cost, of an apparatus which can use a plurality of tone generator devices with no waveform sharing function to perform processing similar to processing performed by a plurality of tone generator devices with a waveform sharing function, without reducing the number of channels and usable waveform data.

In order to accomplish the above-mentioned object, the present invention provides an improved tone generation processing apparatus, which comprises: a plurality of tone generator devices; a plurality of waveform data memories corresponding to the plurality of tone generator devices and exclusively usable by corresponding ones of the plurality of tone generator devices, wherein each of the tone generator devices uses waveform data, stored in the waveform data memory exclusively usable thereby, to generate a waveform signal of a tone indicated by given event information; an event reception section that receives event information indicating a tone to be generated; a tone generator selection section that selects, from among the plurality of tone generator devices, a tone generator device to be used for generating the tone corresponding to the event information received by the event reception section; and a delivery section that delivers the received event information to the tone generator device selected by the tone generator selection section so that a waveform signal of the tone indicated by the received event information is generated by the selected tone generator device.

The present invention is characterized by the provision of the tone generator selection section for selecting, from among the plurality of tone generator devices, a particular tone generator device to be used for generating the tone corresponding to the received event information. Thus, even where a plurality of inexpensive tone generators devices with no waveform-memory sharing function are employed, it is possible to perform appropriate management as to which of the tone generator devices should be used for the tone to be generated. Thus, with the present invention, there is no need to redundantly store same waveform data in each of the waveform data memories of the tone generator devices incapable of sharing a waveform memory, and thus, each of the waveform data memories can be used efficiently. That is, because the present invention allows various waveform data to be stored distributively in the waveform data memories corresponding to the tone generator devices, the present invention can construct or implement a tone generation processing apparatus at reduced overall cost.

For example, arrangements may be made such that, for a same tone color, first waveform data corresponding to a first pitch range, and second waveform data differing in waveform characteristic from the first waveform data and corresponding to a second pitch range, are stored in the waveform data memories corresponding to different ones of the tone generator devices. Such arrangements allow even a same tone color to be stored with waveform data differentiated between pitch ranges. This means that the present invention can not only generate high-quality tone waveform data differing in tone quality between pitch ranges but also expand the maximum number of simultaneously-generatable tones (i.e., tone generation channels) of that tone color up to a sum of the numbers of the tone generation channels in the plurality of tone generator devices. Thus, the same benefits as where a plurality of expensive tone generator devices, capable of sharing a waveform-memory, are employed can be achieved using a plurality of inexpensive tone generator devices incapable of sharing a waveform-memory.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which:

FIG. 1 is a block diagram showing a general hardware setup of an electronic musical instrument to which is applied a tone generation processing apparatus in accordance with an embodiment of the present invention;

FIG. 2 is a diagram showing an example of a tone generator number correspondence table employed in the embodiment of FIG. 1;

FIG. 3 is a flow chart of a tone color selection process performed in the embodiment of FIG. 1.

DETAILED DESCRIPTION OF THE INVENTION

Figure 4:
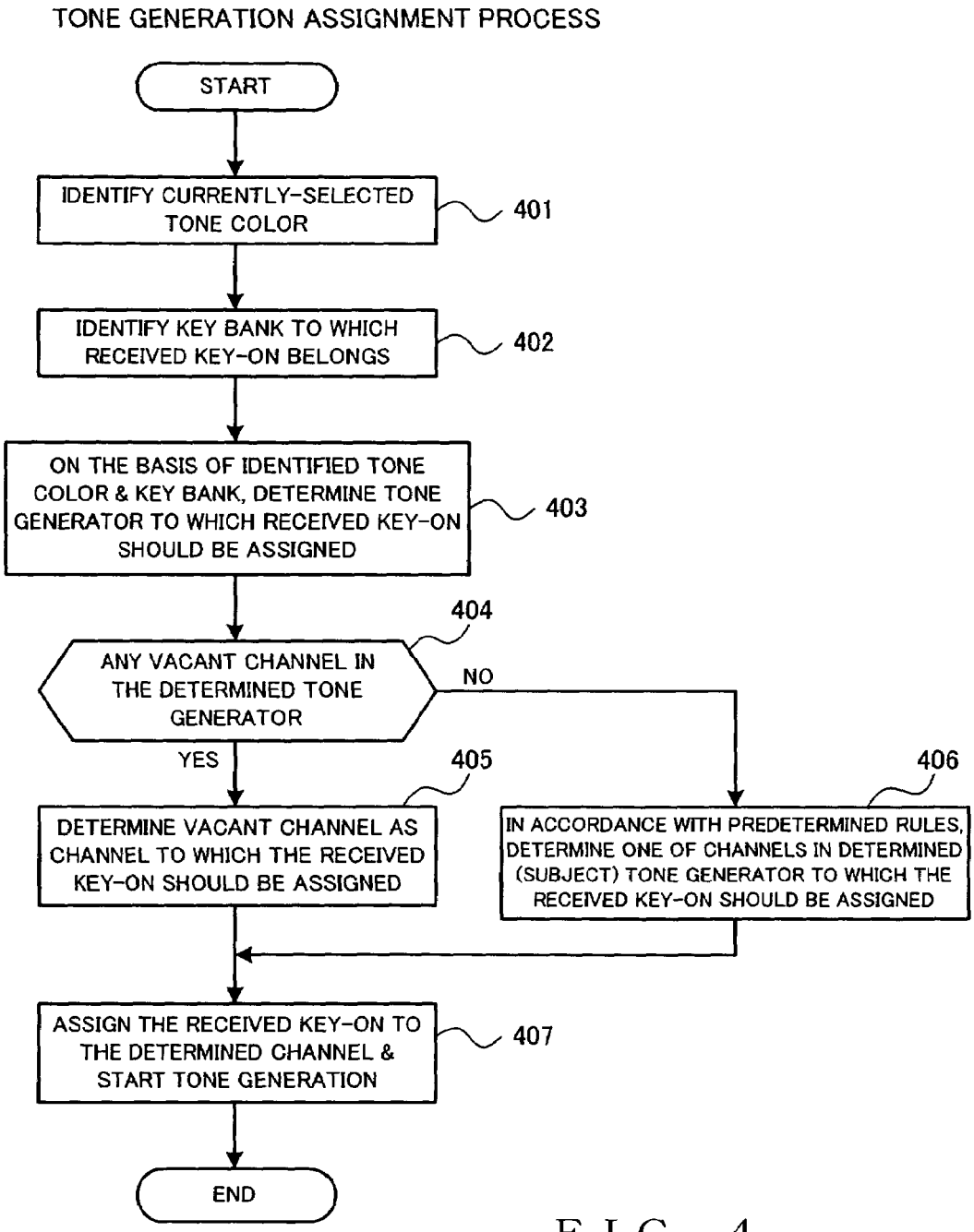
FIG. 4 is a flow chart of a tone generation assignment process performed in the embodiment of FIG. 1.

FIG. 1 is a block diagram showing a general hardware setup of an electronic musical instrument to which is applied a tone generation processing apparatus in accordance with an embodiment of the present invention. This electronic musical instrument includes a central processing unit (CPU) 101, a random access memory (RAM) 102, a first tone generator (hereinafter referred to as "#1 tone generator") 103, a first read-only memory (hereinafter referred to as "#1 ROM") 104, a second tone generator (hereinafter referred to as "#2 tone generator") 105, a second read-only memory (hereinafter referred to as "#2 ROM") 106, an operator unit 107, a detection circuit 108, a display section 109, a display circuit 110, a communication interface (I/F) 112 for connection with external equipment 111, and a communication bus 113 for interconnecting the above-mentioned various components.

The CPU 101 is a processing device for controlling operation of the entire electronic musical instrument. The RAM 102 is a volatile memory into which a program to be executed by the CPU 101 is loaded, and which includes various buffer areas. The #1 tone generator 103 and #2 tone generator 105 each do not have a waveform-memory sharing function; namely, each of the tone generators 103, 105 can not share a waveform memory, storing waveform data for use therein, with the other tone generator, and it uses the waveform memory as a memory dedicated or exclusive thereto. The #1 ROM 104 includes a waveform memory area dedicated to the #1 tone generator 103 and storing waveform data usable only by the #1 tone generator 103, and the waveform memory area is accessible only by the #1 tone generator 103. The #1 ROM 104 functions not only as a waveform memory but also as a CPU memory storing various data and programs to be executed by the CPU 101; for that purpose, the #1 ROM 104 includes a CPU memory area. The #1 ROM 104 is also accessible by the CPU 101. The tone generator (#2 tone generator 105) other than the #1 tone generator 103 does not (or can not) access the #1 ROM 104. The #2 ROM 106 is a waveform memory for exclusive use by the #2 tone generator 105 and has stored therein waveform data that can be used only by the #2 tone generator 105; only the #2 tone generator 105 accesses (or can access) the #2 ROM 106. The tone generator (#1 tone generator) 103 other than the CPU 101 and #2 tone generator 105 does not (or can not) access the #2 ROM 106. Each of the #1 tone generator 103 and #2 tone generator 105 has a plurality of channels (CHs) and can simultaneously generate a plurality of tones in response to a plurality of key-on events being assigned to respective ones of the channels.

The operator unit 107 includes operators, such as a keyboard having a plurality of keys operable by a human operator for a music performance and various switches provided on an operation panel of the electronic musical instrument. Operation on the operator unit 107 is detected by the detection circuit 8, and the detection result is supplied to the CPU 101. The display section 109 is in the form of a display device provided on the operation panel of the electronic musical instrument. The display circuit 110 displays designated information on the display section 109 on the basis of an instruction from the CPU 101. The communication interface (I/F) 112 is an interface for receiving a MIDI event output, for example, from the external equipment 111, such as MIDI equipment. The electronic musical instrument of FIG. 1 can also assign each key-on event (i.e., a tone generation instruction for instructing a tone generator to generate a tone) input via the communication I/F 112.

Because the #1 ROM 104 is a memory accessible by the CPU 101 as well, the #1 ROM 104 is shown in FIG. 1 as connected to the communication bus 113. If the #1 ROM 104 is constructed to function only as a waveform memory for use by the #1 tone generator 103 and is not accessed by the CPU 101, then the #1 ROM 104 may be connected to the #1 tone generator 103, not to the bus 113, in a similar manner to the #2 tone generator 105 connected to the #2 ROM 106.

FIG. 2 shows an example of a tone generator number correspondence table stored in the #1 ROM 104. "tone color number" is a respective identifier of one of tone colors selectable by the electronic musical instrument of the present invention, and a unique tone color number is assigned to each tone color. Each of the tone colors has a plurality of key ranges, and tones are generated using different waveform data per key range. "key number range" represents a range of key numbers (i.e., numbers indicative of tone pitches) allocated to each key range of each tone color, and each key range within each tone color has a unique "key bank number". "tone generator number", which is stored per combination of a tone color (tone color number) and key range (key bank number), represents a tone generator number of a tone generator to be used for generation of a tone corresponding to a key-on event generated in the key range of the tone color. Upon receipt of a key-on event, the CPU 101 refers to the tone generator number correspondence table to acquire a tone color indicated by the key-on event and a tone generator number corresponding to a key number range containing a tone pitch indicated by the key-on event. Tone generation of the received key-on event is assigned to one of the channels of the tone generator of the acquired tone generator number. Respective unique tone generator numbers (#1 and #2) are assigned in advance to the tone generators (#1 tone generator 103 and #2 tone generator 105 provided in the electronic musical instrument). Further, waveform data are stored in advance in the waveform memories (#1 ROM 104 and #2 ROM 106) accessible by the tone generators, per combination between the tone color number to which the tone generator number of the tone generator accessing the waveform memory is allocated and the key bank number.

In accordance with the tone generator number correspondence table of FIG. 2, for example, the #1 tone generator 103 is assigned to a key-on event indicative of tone color number "TC01" and key number "23", the #2 tone generator 105 is assigned to a key-on event indicative of tone color number "TC01" and key number "35", and the #1 tone generator 103 is assigned to a key-on event indicative of tone color number "TC01" and key number "41". Further, in the #1 ROM 104 exclusively usable by the #1 tone generator 103, there are prestored waveform data of all rows where "#1" is attached to the tone generator number, such as: waveform data to be used in response to a key-on event corresponding to a combination of tone color number "TC01" and key bank number "KB01" (i.e., first row of tone color number "TC01"); waveform data to be used in response to a key-on event corresponding to a combination of tone color number "TC01" and key bank number "KB03" (i.e., second row of tone color number "TC01"); and waveform data to be used in response to a key-on event corresponding to a combination of tone color number "TC02" and key bank number "KB01 (i.e., first row of tone color number "TC02"). Similarly, in the #2 ROM 106 exclusively usable by the #2 tone generator 105, there are prestored waveform data of all rows where "#2" is attached to the tone generator number, such as waveform data corresponding to a combination of tone color number "TC01" and key bank number "KB02" and a combination of tone color number "TC02" and key bank number "KB02". As a result, each of sets of waveform data, representative of a tone color but differing from each other between key ranges, are stored in any one of the waveform memories.

FIG. 3 is a flow chart of a tone color selection process that is started up in response to operation for selecting a tone color to be assigned to the keyboard of the operator unit 107. At step 301, the CPU 101 sets the selected tone color as a currently-selected tone color (i.e., a tone color of a tone to be generated in response to depression of a key on the keyboard).

FIG. 4 is a flow chart of a tone generation assignment process that is started up in response to receipt of a key-on event. The "key-on event" is generated, for example, in response to depression of a key on the keyboard, or input from the external equipment 111 via the communication interface 112. At step 401, the CPU 101 identifies the currently-selected tone color (having been set at step 301 of FIG. 3). Then, at step 402, the CPU 101 identifies a key bank to which the received key-on event belongs to, in connection with the identified tone color. At next step 403, the CPU 101 determines, on the basis of the identified tone color and key bank, one of the tone generators (i.e., "subject tone generator") to which the received key-on event should be assigned. The operations at steps 402 and 403 above are intended to acquire a tone generator number allocated to a combination of the currently-selected tone color (tone color number) and a key bank (key bank number) of a key number range to which the key number of the received key-on event belongs, and then sets, as the subject tone generator, the tone generator corresponding to the acquired tone generator number.

At following step 404, a determination is made as to whether the subject tone generator (in this case, the #1 tone generator 103 or #2 tone generator 105) has any vacant channel. With an affirmative answer, the CPU 101 goes to step 405, where the vacant channel is set as a channel (i.e., "assigned-to channel") to which the received key-on event should be assigned. If there is no vacant channel in the subject tone generator, the CPU 101 branches to step 406, where any one of the channels in the subject tone generator is set, in accordance with predetermined rules, as the assigned-to channel to which the received key-on event should be assigned. At step 407, the received key-on event is assigned to the assigned-to channel having been set at step 405 or 406, so that generation of the tone corresponding to the key-on event is carried out. Set of waveform data to be used for the tone generation of the received key-on event is determined on the basis of the combination of the tone color number of the tone color identified at step 401 and the key bank number of the key bank identified at step 402. Once the tone generation is started, the waveform data are sequentially read out from the waveform memory accessed by the subject tone generator, and the thus read-out waveform data are audibly reproduced (or sounded) through the assigned-to channel of the subject tone generator.

According to the present invention, instead of determining the subject tone generator on the basis of the tone color and key bank of the received key-on event, the CPU 101 may first determine, upon receipt of the key-on event, a set of waveform data to be used for generation of the tone corresponding to the received key-on event, then detects one of the tone generators which is capable of generating the tone with the determined waveform data, and then set the detected tone generator as the subject tone generator.

Whereas the embodiment has been described as employing two tone generators, the number of the tone generators may be other than two; for example, there may be employed any desired number of tone generators enough to secure a necessary number of channels for generation of tones. No matter how many tone generators are installed or provided, dedicated waveform memories are provided, in corresponding relation to the tone generators provided, in such a manner that each of the waveform memories is exclusively usable by the corresponding tone generator, and sets of waveform data to be used by the corresponding tone generator are stored in the waveform memory exclusive to the tone generator. Unique tone generator numbers are assigned to all of the tone generators provided, and pieces of information about all of the tone generators are stored in the tone generator number correspondence table.

Preferably, the waveform data assignment to the individual tone generators is made in such a manner that those sets of waveform data having a high possibility of being simultaneously sounded (in the above-described embodiment, waveform data to be used in adjoining key banks within a same tone color) are audibly generated in separate tone generators if at all possible. The waveform data assignment to the individual tone generators may be made in any other manner, without being limited to the above-described scheme of assigning each key bank (waveform data) to any one of the tone generators. For example, for each key bank where a plurality of tone pitches are very likely to be sounded simultaneously, the key bank (key range) may be divided into a plurality of sections so that each of the divided sections is assigned to any one of the tone generators. In this case, tone generator numbers of tone generators to be used are assigned to combinations of the sections and tone color, and the waveform data of the key bank are prestored in the waveform memory of each of the tone generators corresponding to the tone generator numbers assigned to any one of the combinations. In some case, a different key bank may be prepared per touch, in which case the assignment to the tone generator is determined per touch.

Whereas the embodiment has been described as setting a single tone color for the entire key range, the entire key range may be divided into a plurality of key range sections so that a tone color can be set for each of the key range sections. In this case, let it be assumed that, when a key-on event has occurred, a tone color is determined in consideration of the key range section to which the key-on event belongs; subsequent operations are similar to those in relation to the above-described embodiment.

What is claimed is:

1. A tone generation processing apparatus comprising:

a plurality of tone generator devices;

a plurality of waveform data memories corresponding to said plurality of tone generator devices and exclusively usable by corresponding ones of said plurality of tone generator devices, wherein each of said tone generator devices uses waveform data, stored in the waveform data memory exclusively usable thereby, to generate a waveform signal of a tone indicated by given event information;

an event reception section that receives event information indicating a tone to be generated;

a table that determines how to divide, for each of tone colors, an entire pitch range into a plurality of pitch ranges in association with an individual tone color and defines, among said plurality of tone generator devices, a tone generator device to be used for each of combinations of the individual tone color and the pitch ranges associated therewith;

a tone generator selection section that selects, from among said plurality of tone generator devices, a tone generator device to be used for generating the tone corresponding to the event information received by said event reception section, wherein said tone generator selection section includes a pitch range identifying section that identifies a pitch range which said tone corresponding to the event information belongs to by referring to said table on the basis of a selected tone color and a pitch of said tone corresponding to the event information, and a tone generator device determining section that determines a tone generator device to be used for generating the tone corresponding to the event information by referring to said table in accordance with a combination of the selected tone color and the identified pitch range; and a delivery section that delivers the received event information to said tone generator device selected by said tone generator selection section so that a waveform signal of the tone indicated by the received event information is generated by the selected tone generator device.

2. A tone generation processing apparatus as claimed in claim 1 wherein each of said tone generator devices has a plurality of tone generation channels, and wherein said delivery section assigns the received event information to any one of the tone generation channels of the selected tone generator device and delivers the received event information in association with the tone generation channel to which the received event information has been assigned.

3. A tone generation processing apparatus as claimed in claim 1 wherein each of said waveform data memories has waveform data stored therein in association with said combinations of the individual tone color and the pitch ranges defined by said table.

4. A tone generation processing apparatus as claimed in claim 3 wherein for a same tone color, first waveform data corresponding to a first pitch range and second waveform data, differing in waveform characteristic from said first waveform data and corresponding to a second pitch range, are stored in the waveform data memories corresponding to different ones of said tone generator devices.

5. A tone generation processing apparatus as claimed in claim 3 wherein the pitch ranges correspond to key banks, and the key banks correspond to key number ranges divided from each other on the basis of key numbers indicative of tone pitches.

6. A tone generation processing apparatus as claimed in claim 5 wherein waveform data of two key banks adjoining each other in order based on tone pitches are stored in different ones of said waveform data memories.

7. A tone generation processing apparatus as claimed in claim 1 wherein said tone generation processing device is provided within an electronic musical instrument, and said event reception section receives an event generated via a performance operator device provided in the electronic musical instrument.

8. A tone generation processing apparatus as claimed in claim 1 which further comprises a computer, and said event reception section, said tone generator selection section and said delivery section are included in the computer.

9. A tone generation assignment method for a tone generation processing apparatus, said tone generation processing apparatus comprising a plurality of tone generator devices; a plurality of waveform data memories corresponding to the plurality of tone generator devices and exclusively usable by corresponding ones of said plurality of tone generator devices, wherein each of said tone generator devices uses waveform data, stored in the waveform data memory exclusively usable thereby, to generate a waveform signal of a tone indicated by given event information, said tone generation assignment method comprising:

a step of providing a table that determines how to divide, for each of tone colors, an entire pitch range into a plurality of pitch ranges in association with an individual tone color and defines, among said plurality of tone generator devices, a tone generator device to be used for each of combinations of the individual tone color and the pitch ranges associated therewith;

a step of receiving event information indicative of a tone to be generated;

a step of selecting, from among the plurality of tone generator devices, a tone generator device to be used for generating the tone corresponding to the event information received by said step of receiving, wherein said step of selecting includes a step of identifying a pitch range which said tone corresponding to the event information belongs by referring to said table on the basis of a selected tone color and a pitch of said tone corresponding to the event information, and a step of determining a tone generator device to be used for generating the tone corresponding to the event information by referring to said table in accordance with a combination of the selected tone color and the identified pitch range; and a step of delivering the received event information to said tone generator device, selected by said step of selecting, so that a waveform signal of the tone indicated by the received event information is generated by the selected tone generator device.

10. A computer readable storage medium storing a program containing a group of instructions for causing a computer to perform a tone generation assignment method, a plurality of tone generator devices being connected to the computer, waveform data memories being provided in corresponding relation to the tone generator devices, each of the waveform data memories being exclusively usable by a corresponding one of the tone generator devices, wherein each of said tone generator devices uses waveform data, stored in the waveform data memory exclusively usable thereby, to generate a waveform signal of a tone indicated by given event information, said tone generation assignment method comprising:

a step of providing a table that determines how to divide, for each of tone colors, an entire pitch range into a plurality of pitch ranges in association with an individual tone color and defines, among said plurality of tone generator devices, a tone generator device to be used for each of combinations of the individual tone color and the pitch ranges associated therewith;

a step of receiving event information indicative of a tone to be generated;

a step of selecting, from among the plurality of tone generator devices, a tone generator device to be used for generating a tone corresponding to the event information received by said step of receiving, wherein said step of selecting includes a step of identifying a pitch range which said tone corresponding to the event information belongs by referring to said table on the basis of a selected tone color and a pitch of said tone corresponding to the event information, and a step of determining a tone generator device to be used for generating the tone corresponding to the event information by referring to said table in accordance with a combination of the selected tone color and the identified pitch range; and a step of delivering the received event information to the tone generator device selected by said step of selecting so that a waveform signal of the tone indicated by the received event information is generated by the selected tone generator device.

* * * * *